United States Patent [19]

Knop et al.

[11] 4,410,892

[45] Oct. 18, 1983

[54] REFLECTOR-TYPE MICROWAVE ANTENNAS WITH ABSORBER LINED CONICAL FEED

[75] Inventors: Charles M. Knop, Lockport; Edward L. Ostertag, New Lenox; Donald W. Matz, Jr.; Yuk-Bun Cheng, both of Lockport, all of Ill.

[73] Assignee: Andrew Corporation, Orland Park, Ill.

[21] Appl. No.: 267,267

[22] Filed: May 26, 1981

[51] Int. Cl.[3] ..... H01Q 13/00

[52] U.S. Cl. ..... 343/786; 343/781 R

[58] Field of Search ..... 343/781, 837, 840, 786

[56] References Cited

U.S. PATENT DOCUMENTS

| | | | |
|---|---|---|---|
| 3,550,142 | 12/1970 | Dawson . | |
| 3,936,837 | 2/1976 | Coleman et al. | 343/786 |
| 4,249,183 | 2/1981 | Hai | 343/786 |

OTHER PUBLICATIONS

"The Electrical Characteristics of the Conical Horn-Reflector Antenna", *The Bell System Technical Journal*, Jul. 1963, pp. 1187–1211.

*Primary Examiner*—David K. Moore

*Attorney, Agent, or Firm*—Leydig, Voit, Osann, Mayer & Holt, Ltd.

[57] ABSTRACT

A feed horn for a reflector-type microwave antenna comprises a smooth-walled conical horn and a lining of absorber material on the inside wall of the horn for reducing the width of the RPE (radiation pattern envelope) in the E plane of the antenna. The lining of absorber material extends from the wide end of the conical feed toward the narrow end thereof, terminating at a point where the horn diameter is about 7 times the longest wavelength of the microwave signals being transmitted. The width of the RPE in the E-plane of the antenna can be reduced to be nearly equal to the width of the RPE of the H-plane of the antenna without significantly degrading this H-plane RPE from its shape without absorber and without significantly changing the gain of the antenna.

7 Claims, 7 Drawing Figures

FIG. 3
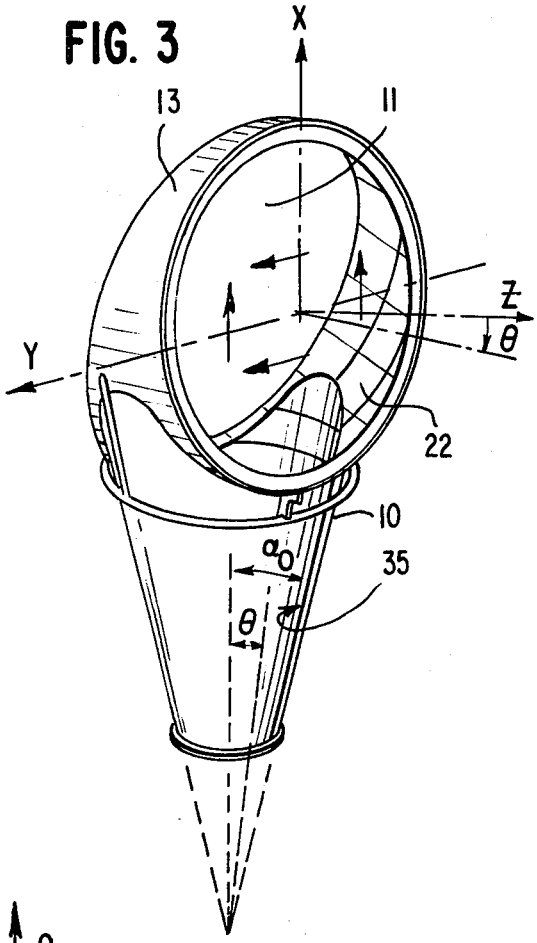
FIG. 4
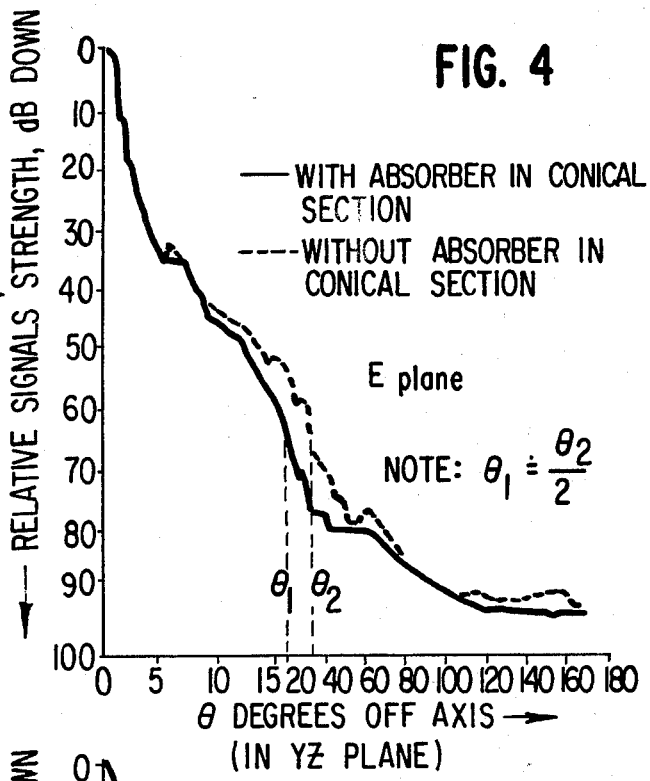
FIG. 6
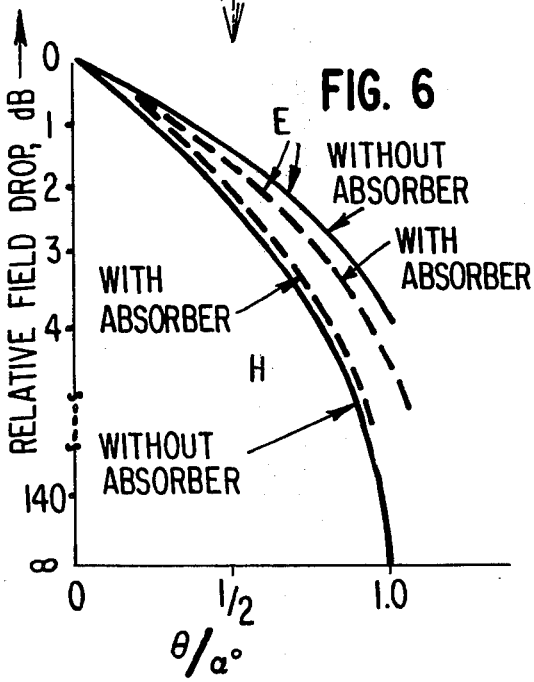
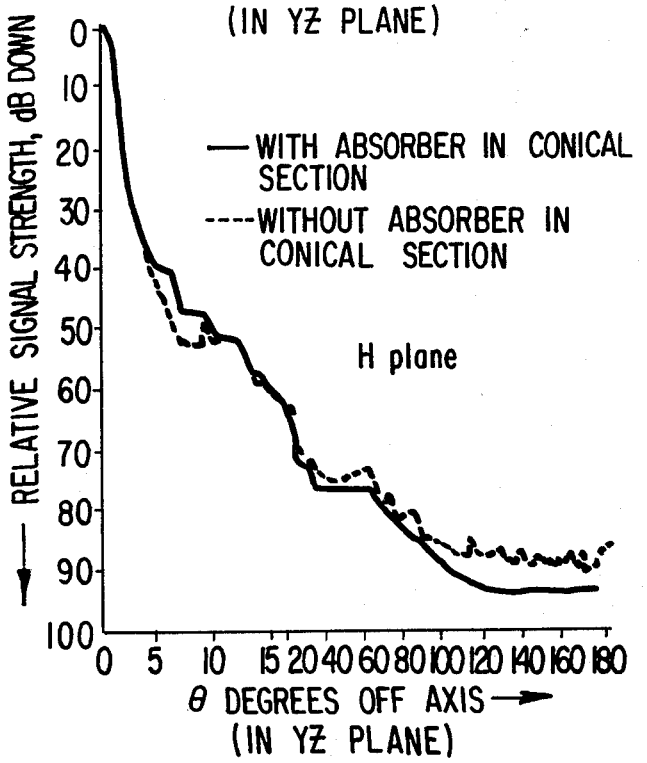
FIG. 5
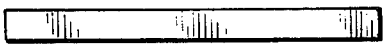
FIG. 7

REFLECTOR-TYPE MICROWAVE ANTENNAS WITH ABSORBER LINED CONICAL FEEDDESCRIPTION OF THE INVENTION

The present invention relates generally to microwave antennas and, more particularly, to reflector-type microwave antennas having conical feeds.

Conical feeds for reflector-type microwave antennas have been known for many years. For example, a 1963 article in *The Bell System Technical Journal* describes the selection of a conical horn-reflector antenna for use in satellite communication ground stations (Hines et al., "The Electrical Characteristics Of The Conical Horn-Reflector Antenna", *The Bell System Technical Journal,* July 1963, pp. 1187–1211). A conical horn-reflector antenna is also described in Dawson U.S. Pat. No. 3,550,142, issued Dec. 22, 1970. Conical feed horns have also been used with large parabolic dish antennas.

One of the problems with smooth-walled conical horn reflector antenna is that its radiation pattern envelope (hereinafter referred to as the "RPE") in the E plane is substantially wider than its RPE in the H plane. When used in terrestrial communication systems, the wide beamwidth in the E plane can cause interference with signals from other antennas. Also, when a smooth-walled conical horn is used as the primary feed for a parabolic dish antenna, its different beamwidths in the E and H planes make it difficult to achieve symmetrical illumination of the parabolic dish.

It is a primary object of the present invention to provide an economical and effective way to achieve significant narrowing of the E-plane RPE of a horn reflector-type antenna having a conical feed, without significantly degrading the H-plane RPE or any other performance characteristic of the antenna.

It is another object of this invention to provide an improved conical feed which provides narrow and substantially equal RPE's in both the E and H planes, and with suppressed sidelobes.

It is yet another object of this invention to provide such an improved conical feed which offers a large bandwidth.

A further object of the invention is to provide such an improved conical feed which achieves the foregoing objectives without any significant adverse effect on the gain of the antenna.

Other objects and advantages of the invention will be apparent from the following detailed description and the accompanying drawings.

In accordance with the present invention, there is provided an improved conical feed for a reflector-type mivrowave antenna, the conical feed comprising a smooth-walled conical section and a lining of absorber material on the inside wall of the conical section for reducing the width of the RPE in the E plane of the antenna without significantly increasing the width of the RPE in the H plane.

In the drawings:

FIG. 3 is a perspective view of the antenna illustrated in FIGS. 1 and 2, with various reference lines superimposed thereon;

FIG. 4 shows two E-plane RPE's produced by the antenna of FIGS. 1–3, with and without an absorber lining in the conical section;

FIG. 5 shows two H-plane RPE's produced by the antenna of FIGS. 1–3, with and without the same absorber lining in the conical section as in FIG. 4;

FIG. 6 is a graphical illustration of the field distribution patterns along the radius of the conical section of the antenna of FIGS. 1–3, with and without the absorber lining in the conical section; and FIG. 7 is an enlarged end view of one of the pads of absorber material used to form an absorber lining in the conical section of the antenna of FIGS. 1–3.

While the invention will be described in connection with certain preferred embodiments, it will be understood that it is not intended to limit the invention to those particular embodiments. On the contrary, it is intended to cover all alternatives, modifications and equivalents as may be included within the spirit and scope of the invention as defined by the appended claims.

Figure 1:
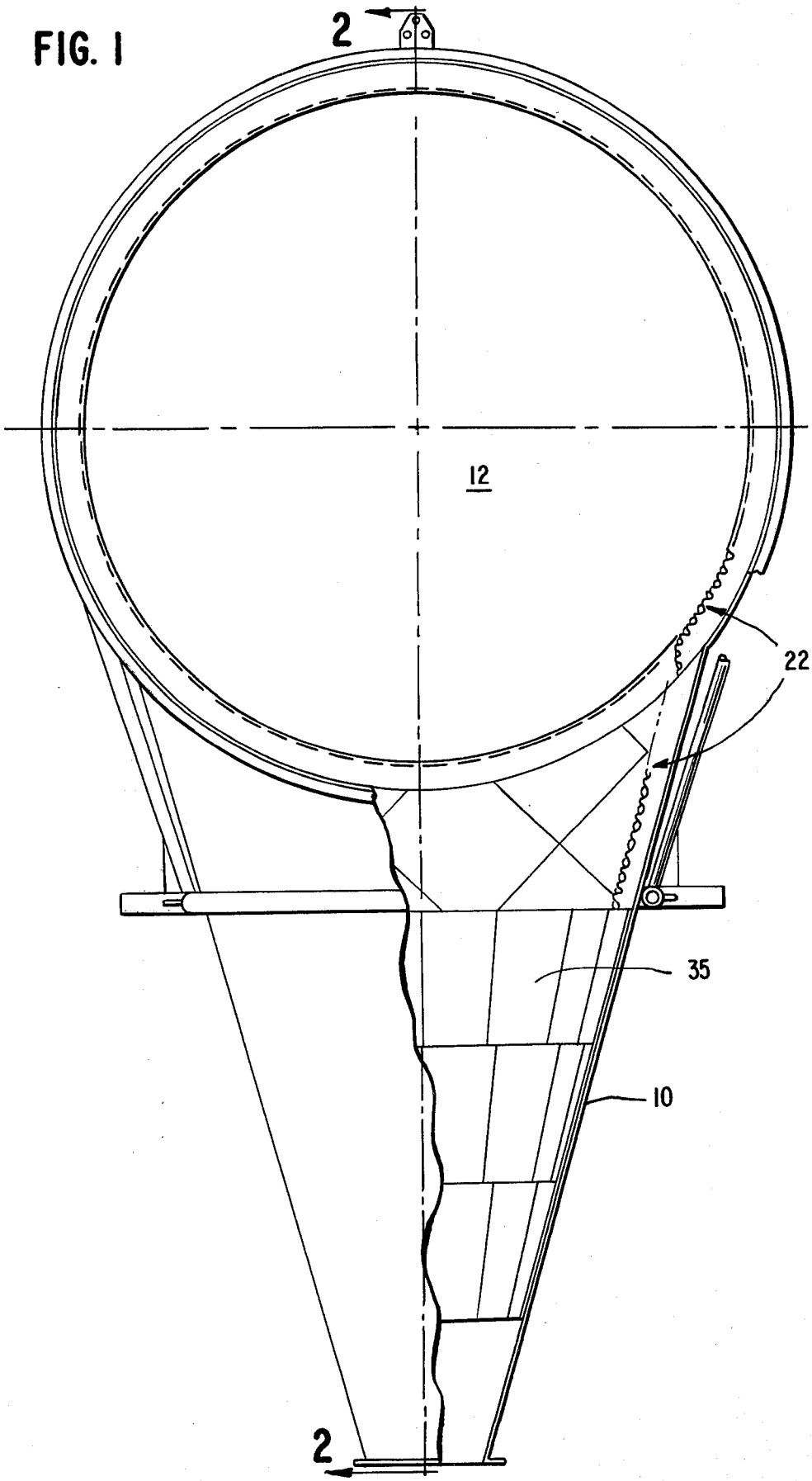
FIG. 1 is a front elevation, partially in section, of a conical horn-reflector antenna embodying the present invention.
Figure 2:
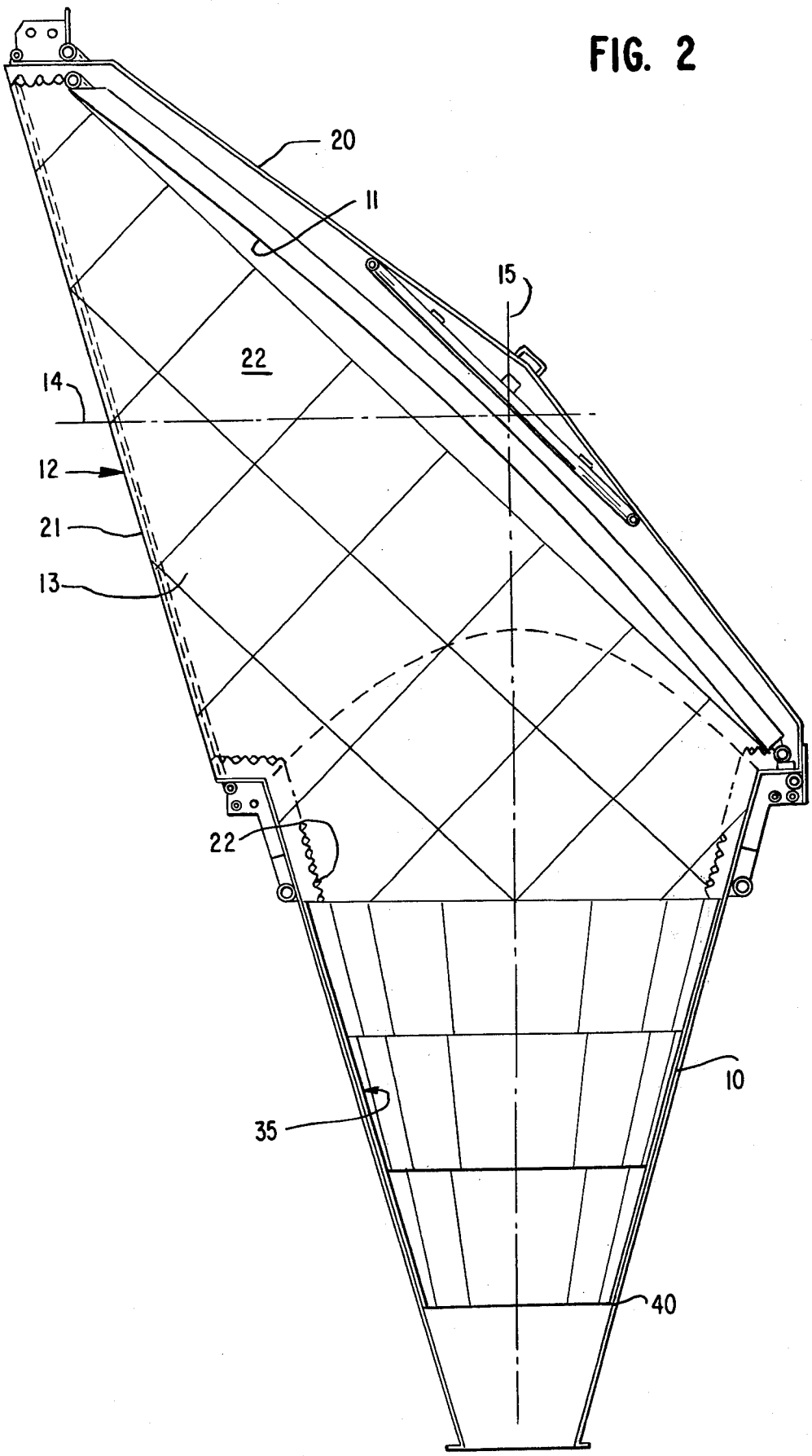
FIG. 2 is a vertical section taken along line 2—2 in FIG. 1.

Turning now to the drawings and referring first to FIGS. 1 and 2, there is illustrated a conical horn-reflector microwave antenna having a conical section 10 for guiding microwave signals to a parabolic reflector plate 11. From the reflector plate 11, the microwave signals are transmitted through an aperture 12 formed in the front of a cylindrical section 13 which is attached to both the conical section 10 and the reflector plate 11 to form a completely enclosed integral antenna structure.

The parabolic reflector plate 11 is a section of a paraboloid representing a surface of revolution formed by rotating a parabolic curve about an axis 41 which extends through the vertex and the focus of the parabolic curve. As is well known, any microwaves originating at the focus of such a parabolic surface will be reflected by the plate 11 in planar wavefronts perpendicular to said axis, i.e., in the direction indicated by the arrow 14 in FIG. 2. Thus, the conical section 10 of the illustrative antenna is arranged so that its apex coincides with the focus of the paraboloid, and so that the axis 15 of the conical section is perpendicular to the axis 41 of the paraboloid. With this geometry, a diverging spherical wave emanating from the conical section 10 and striking the reflector plate 11 is reflected as a plane wave which passes through the aperture 12 and is perpendicular to the axis 14. The cylindrical section 13 serves as a shield which prevents the reflector plate 11 from producing interfering side and back signals and also helps to capture some spillover energy launched from the conical section feed. It will be appreciated that the conical section 10, the reflector plate 11, and the cylindrical shield 13 are usually formed of conductive metal (though it is only essential that the reflector plate 11 have a metallic surface).

To protect the interior of the antenna from both the weather and stray signals, the top of the reflector plate 11 is covered by a panel 20 attached to the cylindrical shield 13. A radome 21 also covers the aperture 12 at the front of the antenna to provide further protection from the weather. The inside surface of the cylindrical shield 12 is covered with an absorber material 22 to absorb stray signals so that they do not degrade the RPE. Such absorber shield materials are well known in the art, and typically comprise a conductive material such as metal or carbon dispersed throughout a dielectric material having a surface in the form of multiple pyramids or convoluted cones.

In accordance with one aspect of the present invention, the metal conical section 10 has a smooth inside wall and a lining of absorber material for reducing the width of the RPE in the E plane of the antenna. Thus, as illustrated in FIGS. 1–3, a lining of absorber material 35 extends from the upper end of the conical section 10 downwardly along the inside surface of the metal cone for a distance sufficient to reduce the width of the RPE in the E plane of the antenna close to the width of the RPE in the H plane (note: this width is usually measured at the 65 dB down level). The absorber material extends continuously around the entire circumference of the inner surface of the cone. It is preferred to continue this lining of absorber material 35 along the length of the conical section 10 to a point 40 where the inside diameter of the cone is reduced to about 7 times the longest wavelength of the microwave signals to be transmitted through the cone. If the absorber lining is continued into regions of smaller diameter within the cone, the $I^2R$ losses in the absorber may become excessive. At the wide end of the conical section, the absorber lining should extend all the way to the end of the cone.

The lining 35 may be formed from conventional absorber materials, one example of which is AAP-ML-73 absorber made by Advanced Absorber Products Inc., 4 Poplar Street, Amesbury, Maine. This absorber material has a flat surface, as illustrated in FIG. 7 (in contrast to the pyramidal or conical surface of the absorber used in the shield), and is about ⅜ inches thick. The absorber material may be secured to the metal walls of the antenna by means of an adhesive. When the exemplary absorber material identified above is employed, it is preferably cut into a multiplicity of relatively small pads which can be butted against each other to form a continuous layer of absorber material over the curvilinear surface to which it is applied. This multiplicity of pads is illustrated by the grid patterns shown in FIGS. 1–3.

The absorber lining 35 within the conical section 10 of the antenna is capable of reducing the width of the E-plane RPE so that it is substantially equal to the width of the H-plane RPE (it does this by reducing all the sidelobes in the E-plane). These improvements are illustrated in FIGS. 4 and 5, which illustrate the E-plane and H-plane RPE's, respectively. The broken-line curves in FIGS. 4 and 5 illustrate the RPE's produced without any absorber in the conical section of the antenna of FIGS. 1–3, and the solid line curves illustrate the RPE's obtained with the absorber lining in the conical section of the antenna. It can be seen that the absorber lining causes a significant reduction in the width of the E-plane RPE, without producing any significant change in the width of the H-plane RPE. For example, comparing the 65–dB levels of the two RPE's in FIGS. 4 and 5 (as noted above 65 dB is a reference point commonly used in specifying the performance characteristics of such antennas), it can be seen that the width of both the E-plane RPE and the H-plane RPE at this level is about 20° off the axis. That is, the width of the E-plane and H-plane RPE's are about equal at the 65-dB level. The 65-dB E-plane width with absorber (FIG. 4) is seen to be narrowed to about one half of that without absorber, i.e., $\theta_1 \doteq \theta_2/2$. Furthermore, these improvements are obtained with only a trivial loss in gain, i.e., the total antenna gain of about 43 dB is reduced by less than 0.2 dB.

The absorber lining within the conical section causes the field distribution within the cone to taper off more sharply adjacent to the inside surface of the cone, due to the fact that the wall impedance of the absorber lining tends to force the perpendicular E field to zero. Furthermore, it does this while abstracting only a small fraction of the passing microwave energy propagating through the cone. This is illustrated graphically in FIG. 6, which shows several different tapers in the field distribution across the conical section, with the horizontal axis representing the radius of the conical section. More specifically, the zero point on the horizontal axis in FIG. 6 represents the location of the axis of the cone in any given plane perpendicular to that axis, and the 1.0 point on the horizontal axis represents the location of the cone wall in the same plane. The numerical values on this horizontal axis represent the ratio $\theta/\alpha_0$, in which $\theta$ is the angle off the cone axis and $\alpha_0$ is the cone half angle (see FIG. 6). The zero point at the top of the vertical axis represents the field strength at the axis of the cone, and the remaining numerical values on the vertical axis represent the reduction in field strength, in dB's, from the field strength at the axis. The solid-line curves in FIG. 6 represent the E-plane and H-plane field distributions across a cone without the absorber lining, and the broken-line curves represent the E-plane and H-plane field distributions across a cone with the absorber lining.

As can be seen from the solid-line curves in FIG. 6, there is a substantial difference in the taper or drop-off of the field distributions in the E and H planes in the absence of the absorber lining. The broken-line curves show that when the absorber lining is added, the E-plane field distribution tapers off much more sharply, approaching that of the H-plane field, while there is only a slight degradation in the H-plane taper which brings it even closer to the E-plane field. In the theoretically ideal situation, the H-plane field distribution would retain the solid line profile, and the profile of the E-plane field distribution would coincide with that of the H plane. In actual practice, however, this theoretically ideal condition can only be approximated, as illustrated by the broken-line curves in FIG. 6.

Mathematically, the operation of the feed horn may be characterized as follows. If we let $E\theta\ (\pi, \theta, \phi)$ and $E\phi\ (\pi, \theta, \phi)$ be the polar and azimuthal components of electric field (with origin at the apex of the cone, and $\theta$ and $\phi$ the polar and azimuthal angle, respectively) then, it can be shown that they can be mathematically expressed as:

$$E\theta(\pi,\theta,\phi)=A\,f(w)\cos\phi \tag{1}$$

$$E\phi(\pi,\theta,\phi)=-A\,g(w)\sin\phi \tag{2}$$

where $$A=E_0 exp(-jkr)/kr \tag{3}$$

$E_o$=Arbitrary driving constant, $k=2\pi/\lambda$, $\lambda$=free space operating wavelength and the functions f(w) and g(w) are given by:

$$f(w)=J_1(X)/X+R_sJ_1'(X) \tag{4}$$

$$g(w)=R_sJ_1(X)/X+J_1'(X) \tag{5}$$

with $$X=E\theta/\alpha_0 \tag{6}$$

$$J_1(X)=\text{Bessel function of Order 1, argument X} \tag{7}$$

$$J_1'(X) = \text{Derivitive of } J_1(X) \text{ with respect to } X \quad (8)$$

One then notes that the fields are uniquely known for the range of $0 \leqq \theta \leqq \alpha_0$ and $0 \leqq \phi \leqq 360°$ if the parameters E (the Eigen value) and Rs (the spherical hybridicity factor) are known. These parameters are uniquely determined by the nature of the conical wall material.

No Absorber

For no absorber present one can show that E=1.84 and Rs=0, thus giving:

$$f(w) = J_1(1.84\ \theta/\alpha_0)/(1.84\ \theta/\alpha_0) \quad (9)$$

$$g(w) = J_1'(1.84\ \theta/\alpha_0) \quad (10)$$

where amplitude distributions (in dB normalized to on axis, $\theta=0$) are shown as the solid lines in FIG. 6 (Note: E-plane $= -20\log_{10}|f(w)/f(w)|_{\varsigma=0}|$ H plane $= -20\log_{10}|g(w)/g(w)|_{w=0}|$).

Perfect Absorber

For the perfect absorber case (also a corrugated horn with quarter wave teeth) it can be shown that E=2.39, Rs=+1, thus giving $$f(w) = g(w) = J(2.39\ \theta/\alpha_0), \text{ perfect absorber} \quad (11)$$

where the identity $$J_1(X)/X + J_1'(X) = J_o(X) \quad (12)$$

has been used, with $J_o(X)$=Bessel function of order zero, argument X. One notes that the dB plot of (11) is virtually identical to that of (10), thus showing that the H plane of the smooth wall and perfect absorber wall are virtually identical. Also, for this perfect absorber case, we then see that the E plane is identical to the H plane.

Actual Absorber

An actual absorber has E differing from the no absorber case of 1.84 and the perfect absorber case of 2.39, with a hybridcity factor, Rs, neither zero (no absorber) or unity (perfect absorber). In general both will be complex with finite loss in the absorber. Typical E and H plane plots are shown dotted in FIG. 6 and show, as previously discussed, that the E plane is greatly tapered from the no absorber case while the H plane is only slightly widened, thus achieving the desired effect.

A further advantage of the present invention is that the RPE improvements can be achieved over a relatively wide frequency band. For example, the improvements described above for the antenna illustrated in FIGS. 1-3 can be realized over the common carrier frequency bands commonly referred to as the 4 GHz, 6 GHz and 11 GHz bands.

Absorber materials are generally characterized by three parameters: thickness, dielectric constant, and loss tangent. The absorber used in the present invention must have a thickness and loss tangent sufficient to suppress undesirable surface (slow) waves. Such surface waves can be readily generated at the transition from the metallic portion of the inside surface of the cone wall to the absorber-lined portion of the cone wall, but these waves are attenuated by the absorber so that they do not interfere with the desired field pattern of the energy striking the reflector plate 11. The end result is that all the improvements described above are attained without producing any undesirable distortion in the field patterns. The narrowing E-plane effect can, in fact, be achieved with zero loss tangent material, but with no loss the surface waves are not attenuated and the operating bandwidth is reduced. Consequently, it is preferred to use an absorber material with some loss.

Although the invention has been described with particular reference to a horn-reflector antenna, it will be appreciated that the invention can also be used to advantage in a primary feed horn for a dish-type antenna. Indeed, in the latter application the substantially equal main beam widths in the E and H planes provided by the absorber lined feed horn are particularly advantageous because they provide symmetrical illumination of the parabolic dish. The consequent approximately equal secondary patterns with their reduced sidelobes, over a wide bandwidth, and with negligible gain loss, are also important in this primary feed horn application.

As can be seen from the foregoing description, this invention provides an economical and effective way to achieve significant narrowing of the E-plane RPE of a reflector-type antenna having a conical feed, without significantly degrading the H-plate RPE or any other performance characteristic of the antenna. The absorber lining in the conical feed produces a narrow RPE in the E plane while perserving the already narrow RPE in the H plane, and these RPE's can be made nearly equal in width. Furthermore, these improvements are achieved over large bandwidth (e.g., 4 to 12 GHz) with no significant adverse effect on the gain of the antenna or on its VSWR.

Although, the invention has thus far been described with particular reference to a conical feed horn in the shape of a truncated right circular cone, it can be appreciated that use of absorber lining on other conical shapes such as pyramidal (or other shapes) feed horns will produce the same desirable effect (i.e. narrowing of the E plane RPE to make it approximately equal to the H plane RPE).

We claim as our invention:

1. A conical horn-reflector antenna comprising the combination of:
   - a paraboloidal reflector forming a paraboloidal reflecting surface for transmitting and receiving microwave energy,
   - a smooth-walled conical feed horn for guiding microwave energy from the focus of said paraboloidal reflecting surface to said reflector, and
   - a lining of absorber material on the inside wall of the horn for reducing the width of the RPE in the E plane of the antenna without significantly increasing the width of the RPE in the H plane, said absorber increasing the Eigen value E and the sperical hybridicity factor Rs sufficiently to cause the E plane and H plane RPEs to approach each other.

2. A conical horn-reflector antenna as set forth in claim 1 wherein said absorber material reduces the width of the RPE in the E plane of the antenna close to the width of the RPE in the H plane of the antenna.

3. A conical horn-reflector antenna as set forth in claim 2 which produces substantially equal E and H plane illumination patterns.

4. A conical horn-reflector antenna as set forth in claim 1 wherein said lining of absorber material extends from the wide end of the conical horn toward the narrow end thereof, terminating at a point where the horn diameter is at least about seven times the longest wavelength of the microwave signals to be transmitted through the horn.

5. A method of reducing the width of the RPE pattern envelope in the E plane of a conical horn-reflector antenna having a paraboloidal reflector forming a paraboloidal reflecting surface for transmitting and receiving microwave energy, and a smooth-walled conical feed horn for guiding microwave energy from the focus of said paraboloidal reflecting surface to said reflector, said method comprising lining at least a portion of the inside wall of said feed horn adjacent to the wide end thereof with an absorber material which increases the taper of the field distribution along the radii of said horn in the E plane, said absorber increasing the Eigen value E and the sperical hybridicity factor Rs sufficiently to cause the E plane and H plane RPEs to approach each other.

6. A method as set forth in claim 5 wherein said lining of absorber material increases the taper of the field distribution along the radii of said horn in the E plane to closely approximate the taper of the field distribution along the radii of said horn in the H plane.

7. A method as set forth in claim 5 wherein said lining of absorber material extends from a point in said horn where the horn diameter is at least about seven times the longest wavelength of the microwave signal to be transmitted through the horn, continuously to the wide end of the horn.

* * * * *

US004410892B1

REEXAMINATION CERTIFICATE (1806th)

United States Patent [19]

[11] B1 4,410,892

Knop et al.

[45] Certificate Issued Oct. 13, 1992

[54] REFLECTOR-TYPE MICROWAVE ANTENNAS WITH ABSORBER LINED CONICAL FEED

[75] Inventors: Charles M. Knop, Lockport; Edward L. Ostertag, New Lenox; Donald W. Matz, Jr.; Yuk-Bun Cheng, both of Lockport, all of Ill.

[73] Assignee: Andrew Corporation, Orland Park, Ill.

Reexamination Request:
No. 90/002,378, Jun. 25, 1991

Reexamination Certificate for:

| | |
|---|---|
| Patent No.: | **4,410,892** |
| Issued: | **Oct. 18, 1983** |
| Appl. No.: | **267,267** |
| Filed: | **May 26, 1981** |

[51] Int. Cl.[5] ..... H01Q 13/00
[52] U.S. Cl. ..... 343/786; 343/781 R
[58] Field of Search ..... 343/781 R, 786, 840, 343/837

[56] References Cited

U.S. PATENT DOCUMENTS 3,550,142 3/1968 Dawson .
3,936,837 2/1976 Coleman et al. .
4,249,183 2/1981 Bui Hai .

FOREIGN PATENT DOCUMENTS 0000305 1/1979 European Pat. Off. .

*Primary Examiner*—Michael C. Wimer

[57] ABSTRACT

A feed horn for a reflector-type microwave antenna comprises a smooth-walled conical horn and a lining of absorber material on the inside wall of the horn for reducing the width of the RPE (radiation pattern envelope) in the E plane of the antenna. The lining of absorber material extends from the wide end of the conical feed toward the narrow end thereof, terminating at a point where the horn diameter is about 7 times the longest wavelength of the microwave signals being transmitted. The width of the RPE in the E-plane of the antenna can be reduced to be nearly equal to the width of the RPE of the H-plane of the antenna without significantly degrading this H-plane RPE from its shape without absorber and without significantly changing the gain of the antenna.

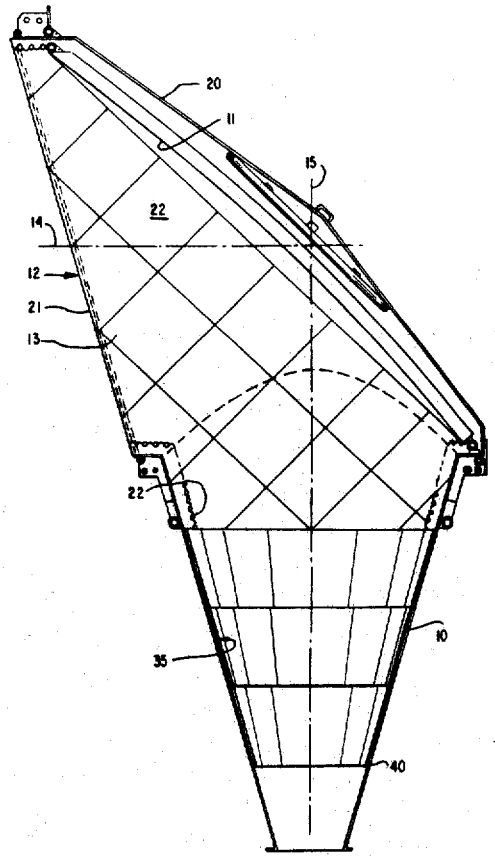

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1-7 is confirmed.

* * * * *